United States Patent [19]

Büchler

[11] Patent Number: 4,506,823

[45] **Date of Patent: * Mar. 26, 1985**

[54] LETTER CARD AND CONFINING MEANS THEREFOR

[75] Inventor: Ingrid Büchler, Merzig, Fed. Rep. of Germany

[73] Assignee: Villeroy & Boch Keramische Werke KG, Mettlach, Fed. Rep. of Germany

[ * ] Notice: The portion of the term of this patent subsequent to Aug. 30, 2000 has been disclaimed.

[21] Appl. No.: 524,032

[22] Filed: Aug. 17, 1983

Related U.S. Application Data

[63] Continuation-in-part of Ser. No. 308,090, Oct. 2, 1981, Pat. No. 4,401,258.

[30] Foreign Application Priority Data

Feb. 17, 1981 [DE] Fed. Rep. of Germany ..... 3105728

[51] Int. Cl.[3] ..... B65D 85/30; B42D 15/02

[52] U.S. Cl. ..... 229/92.8; 206/454; 206/521

[58] Field of Search ..... 206/454, 521; 40/152.1, 40/154, 156, 158, 539; D7/1; 229/92.8, 71; 283/1.5; 248/152; D19/3, 4, 6; D6/232, 241, 243

[56] References Cited

U.S. PATENT DOCUMENTS

| | | | |
|---|---|---|---|
| D. 36,369 | 6/1903 | Bruch | D19/6 |
| D. 38,249 | 9/1906 | Williamson | D7/1 |
| 878,556 | 2/1908 | Palm, Jr. | 229/92.8 |
| 1,421,097 | 6/1922 | Pente | 229/71 |
| 1,632,185 | 6/1927 | Jenner . | |
| 2,389,511 | 11/1945 | Horr | 40/152.1 |
| 2,576,667 | 11/1951 | Bly | 229/92.8 |
| 2,646,876 | 7/1953 | Sparks | 229/92.8 |
| 3,586,234 | 6/1971 | Nathan et al. | 206/454 X |
| 3,939,978 | 2/1976 | Thomaswick | 206/454 |
| 3,986,283 | 10/1976 | Pelaez | 229/92.8 X |
| 4,063,378 | 12/1977 | Burke | 40/156 |
| 4,087,576 | 5/1978 | Patterson | 229/92.8 X |
| 4,401,258 | 8/1983 | Büchler | 229/92.8 |

FOREIGN PATENT DOCUMENTS

| | | |
|---|---|---|
| 132991 | 7/1902 | Fed. Rep. of Germany . |
| 1831846 | 5/1961 | Fed. Rep. of Germany . |
| 1265969 | 5/1961 | France . |
| 1432768 | 12/1966 | France . |
| 1484790 | 6/1967 | France . |
| 1499377 | 10/1967 | France . |
| 2168736 | 8/1973 | France . |
| 2205007 | 5/1974 | France . |
| 17178 | of 1913 | United Kingdom . |

*Primary Examiner*—Allan N. Shoap
*Assistant Examiner*—Bryon Gehman
*Attorney, Agent, or Firm*—Peter K. Kontler

[57] ABSTRACT

A letter whose letter card consists of one or more plates of hard-paste china bearing one or more messages in the form of images, handwritten notes, proverbs, verses or the like. The envelope for the letter card consists of relatively stiff and shock-absorbent material, such as corrugated cardboard. Prior to introduction into the envelope, the letter card is placed into a recess formed in one side of an insert which snugly fits into the envelope and is also made of corrugated cardboard. The letter card can be assembled of two plates which are pivotally connected to each other by one or more flexible strips so that they can pivot relative to each other between first positions of full overlap and second positions in which they are located in mutually inclined planes. The letter card can be placed on a table top, suspended on a wall, framed or otherwise set up for more or less permanent exhibition in a home, office, dormitory, military barracks or the like. The plate or plates of the letter card can have an outline other than a rectangular outline. The rear side of each plate can be bonded to a sheet of paper or cardboard serving to receive handwritten and/or printed messages.

20 Claims, 10 Drawing Figures

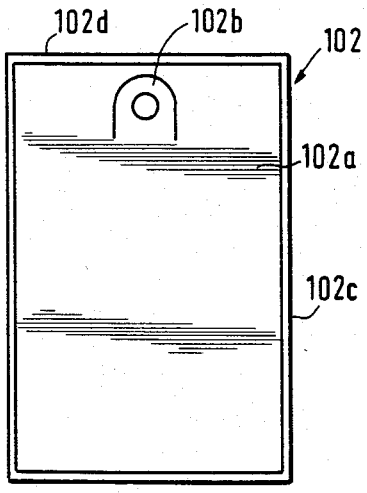
FIG. 4
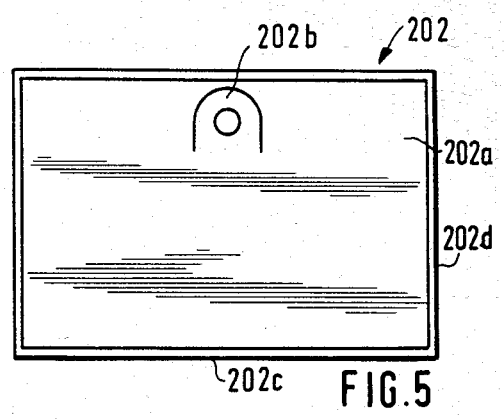
FIG.5
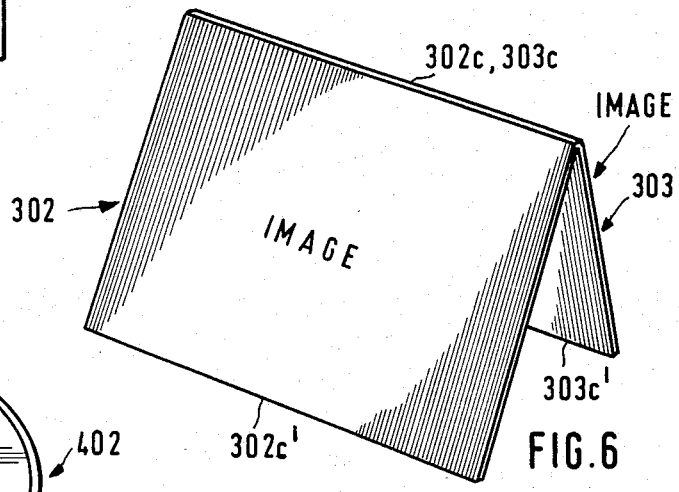
FIG.6
FIG.7
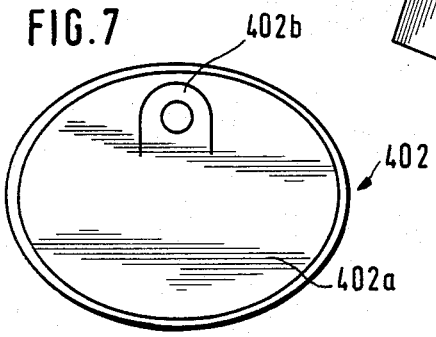
FIG.8
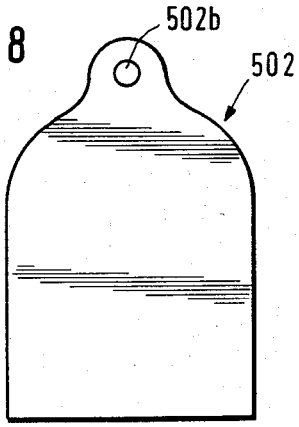
FIG.9
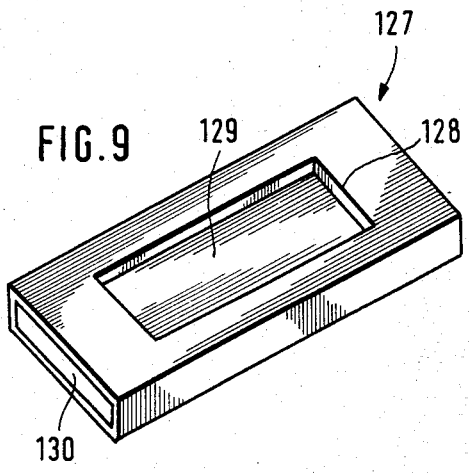

LETTER CARD AND CONFINING MEANS THEREFOR

CROSS-REFERENCE TO RELATED CASE

This is a continuation-in-part of my copending patent application Ser. No. 308,090 filed Oct. 2, 1981, now U.S. Pat. No. 4,401,258 granted Aug. 30, 1983.

BACKGROUND OF THE INVENTION

The present invention relates to letters in general, i.e., to a combination of an envelope with one or more message-bearing sheet- or plate-like inserts which are receivable in the envelope for mailing or other mode of transport to the recipient whose name and address normally appear on the envelope. Still more particularly, the invention relates to improvements in letters of the type wherein the insert is a so-called letter card, namely, a card which is made of relatively stiff material (as contrasted with regular-weight paper which is used for the writing of regular letters and especially with relatively thin or very thin paper which is often used in the envelopes of airmail letters).

Letter cards are customarily sent to friends, relatives, acquaintances, business associates, schoolmates and other parties on special occasions, such as on holidays, to express sympathy in the event of death or accident, to send a congratulatory message to newlyweds, successful graduates, parents of newly born children, persons celebrating birthdays or anniversaries, and for many other reasons including Valentine's day, St. Patrick's day, etc. The nature of letter cards can vary from a simple one-sheet card of negligible value to highly expensive and/or valuable multiple-panel cards which bear information in the form of messages or other representations such as multi-colored prints some of which are or can be classified as works of artists. The lettering may be simple or highly complex, and the message may include a proverb, a verse, excerpts from a literary work, expressions of love, affection, sympathy or admiration in language which is customary on mass-produced greeting and like cards, an image which is an original or a reproduction of the work of a famous or budding artist, and/or a combination of these.

A drawback of presently known letters which contain or which at one time contained letter cards is that the recipient cannot enjoy or is not likely to enjoy the letter card for a relatively long period of time. Thus, many recipients of cards will stash them away shortly after arrival and, if not discarded after a reasonably short period of time, the cards are condemned to relatively short or long existence in total or practically total obscurity, normally at the bottom of a drawer, in a file or in the attic. The reason is that practically all of the presently manufactured letter cards have a limited useful life, i.e., the inscriptions will fade with time, the colors of the images become dull, the color of the material of the card fades with time, the card cannot stand pronounced flexing or other stresses, the card can be damaged and/or destroyed on contact with water or other liquids, and the messages which are written in ink are particularly likely to become illegible after a relatively short period of storage, depending on the locus of storage and the climate. Moreover, a conventional letter card is not suited for exhibition, either by resting on a table top or an analogous support or by being suspended on a wall, door or the like. Therefore, and unless collected for special reasons, letter cards are normally discarded much more rapidly than regular or picture post cards because the post cards are often prized by stamp collectors.

OBJECTS AND SUMMARY OF THE INVENTION

An object of the invention is to provide a novel and improved letter card-containing letter whose card can be more readily exhibited and whose useful life is longer than that of heretofore known letter cards.

Another object of the invention is to provide a novel and improved envelope for use with a letter card of the above outlined character.

A further object of the invention is to provide a letter card whose useful life is practically unlimited, whose appearance does not deteriorate with time, which can be enjoyed by children, teenagers and/or adults, which is much less likely to be rapidly discarded then heretofore known letter cards, and whose value to the addressee is likely to increase with time.

An additional object of the invention is to provide a letter whose letter card is constructed and designed in such a way that it can readily accept and retain a message in any one of a practically unlimited number of different forms including prose, poetry, images and/or a combination thereof.

A further object of the invention is to provide the letter with novel and improved means for protecting or shielding the letter card during shipment, mailing or other type of transport to the addressee or recipient.

An additional object of the invention is to provide a letter card which can be readily exhibited in any one of a number of different ways including deposition on a support, suspension on a support, framing, bonding to a carrier and/or others.

A further object of the invention is to provide a letter card which is appreciated by young persons and/or adults, which can retain messages of sentimental or other value for one or more generations, and which can be furnished in a wide variety of sizes, shapes, weights and/or finishes.

Another object of the invention is to provide a novel and improved letter card which can be observed from different sides with the same eye-pleasing effect, which can be configurated in such a way that its shape is suggestive of the occasion for which the card is to be sent to a relative, acquaintance, business associate or another person or group of persons, and which can be designed to commemorate certain regularly or irregularly occurring events so that an interested party can start a collection of such letter cards for his or her own enjoyment or as an investment.

The invention resides in the provision of a letter comprising a letter card including at least one plate consisting of a ceramic material, and an at least substantially rigid and shock-absorbent envelope (preferably an envelope which constitutes a hollow parallelepiped) for the letter card. At least one side of the plate is preferably provided with decorative material, such as combinations of letters (e.g., proverbs, verses, excerpts from famous literary works including the Bible or the like), pictures, images and the like. At least a portion of at least one side of the plate exhibits a finish which is susceptible to the application and retention of handwritten information, such as greetings, congratulations, expressions of sympathy or the like. This portion may have a matte finish or it may be porous and absorbent so that it can readily accept regular or special ink, lacquer and/or other substances which ensure longlasting or permanent readability of the message or messages.

The letter card may comprise two ceramic plates and adhesive-coated plastic strips or analogous means for articulately connecting the plates to one another for movement between first positions in which the plates are adjacent to and overlie each other (i.e., in which the plates form a stack) and second positions in which the plates are disposed in two mutually inclined planes (in such second positions, the plates preferably constitute a substantially roof-shaped letter card). The plates have elongated edge faces and the connecting means is preferably arranged to couple the plates to one another in the region of such edge faces so that the plates are pivotable between the aforementioned first and second positions. Retaining means may be provided for holding the plates against movement beyond the second positions; such retaining means may comprise a strip, web, tube or a like body which is preferably flexible or otherwise deformable and whose end portions are permanently or separably connected to the inner sides of the two plates along those edge faces which are remote from the connecting means so as to ensure that the plates will remain in the aforementioned mutually inclined planes (for example, when placed on top of a desk, table, night stand, cabinet or other piece of furniture) to produce a decorative effect and serve as a practically permanent memento of the occasion on which the letter was received from a friend, a relative, an acquaintence, a business associate or another party.

The letter may further comprise means for facilitating suspension of the plate or plates on a wall or the like. For example, the plate or one of several plates may be provided with a layer of porous absorbent material (such as a sheet of paper, textile or a synthetic plastic material) which facilitates the application of a message and is capable of retaining such inscribed matter for long or practically unlimited periods of time, and the suspension facilitating means may constitute a portion (e.g., an eyelet-like extension) of such layer.

The envelope preferably consists of or may include corrugated cardboard or an equivalent deformation-resistant and shock-absorbent material. Such envelope may comprise two substantially parallel major panels and four side walls disposed between the two major panels. Fold lines are preferably provided between the neighboring side walls as well as between the side walls on the one hand and the panels on the other hand. One of the panels is preferably a composite panel including four lugs each of which is connected to a different side wall. The lugs may include a first pair of lugs which partially overlap one another, and a second pair of lugs which partially overlap one another and also overlap the lugs of the first pair. The lugs of the second pair are preferably provided with means for separably coupling them to one another; for example, one of these lugs can have a tongue and the other of these lugs can have a slot for insertion of the tongue.

Still further, the envelope preferably comprises an insert for directly but removably confining the plate. The insert is removably and preferably snugly received in the envelope and may constitute a parallelepiped which consists, at least in part, of a rigid material such as corrugated cardboard. One side of the insert is preferably formed with a recess, socket or window into which the plate or plates are inserted with minimal clearance so as to be held in frictional engagement with the material of the insert.

One of the presently preferred materials for the plate or plates is hard-paste china.

The improved letter card can be set up in upright position or with the longer sides extending horizontally. Also, the message can be applied to a sheet of paper, cardboard or other stationery material which is simply pasted to the rear side of the letter card. If desired, the letter card can comprise two mirror symmetrical ceramic plates the outer side of each of which bears an image or a series of images so that the eye-pleasing effect of the card is the same whether the card is viewed from the front side or from the rear side. The card can resemble a bell, a caraffe, a flower or any other object which is suggestive of the occasion for which the card is to be mailed or delivered (e.g., wedding, anniversary, engagement, funeral, graduation, etc.).

The protecting insert can have a lateral slot for insertion of the letter card, and its front side can be provided with a window for a light-transmitting pane to allow for determination of its contents without removing such contents from the insert.

The novel features which are considered as characteristic of the invention are set forth in particular in the appended claims. The improved letter itself, however, both as to its construction and the mode of assembling and exhibiting its card, together with additional features and advantages thereof, will be best understood upon perusal of the following detailed description of certain specific embodiments with reference to the accompanying drawing.

BRIEF DESCRIPTION OF THE DRAWING

FIG. 4 a rear elevational view of an upright letter card having a single panel and a sheet of paper or cardboard pasted to its rear side for reception of messages from the sender(s) to the recipient(s);

FIG. 5 is a similar rear elevational view of a single-panel card which can be suspended in such a way that its longer sides are substantially horizontal;

FIG. 6 is a perspective view of a letter card which is similar to that of FIG. 1 except that it is provided with images or other eye-pleasing material at the outer sides of both plates;

FIG. 7 is a rear elevational view of an oval letter card;

FIG. 8 is a rear elevational view of a letter card which resembles a bottle or a bell so that its appearance suggests the occasion for which it is to be sent to a recipient;

FIG. 9 is a perspective view of a modified insert which has a lateral slot and a light-transmitting pane in its front window.

DESCRIPTION OF THE PREFERRED EMBODIMENTS

Figure 1:
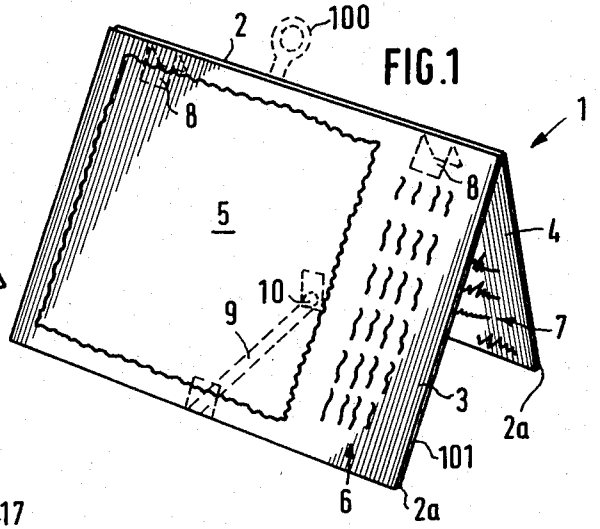
FIG. 1 is a somewhat schematic perspective view of a two-plate letter card forming part of a letter which embodies the invention.

Referring first to FIG. 1, there is shown a foldable letter card 1 which includes two plate-like sections or units 3 and 4 (hereinafter called plates). The plates 3 and 4 have neighboring elongated upper edge portions 2 and are articulately connected to each other by two or more preferably transparent or translucent strips 8 consisting of a suitable synthetic plastic material or the like. The connecting strips 8 enable the recipient to move the plates 3, 4 between first positions in which they overlie each other and are disposed in two parallel planes, and the illustrated second positions in which the plates are disposed in two mutually inclined planes and make an angle preferably not exceeding 90 degrees. In such second positions, the plates 3 and 4 together constitute a substantially roof-shaped structure which can be readily exhibited on a table top or the like by causing the lower edge portions *2a* of the plates to rest on the surface of the supporting body. The letter card 1 further comprises a suitable retaining element 9 which is or may constitute a web, tube or strip of flexible material one end portion of which is permanently or detachably secured to the inner side of the front plate 3 and the other end portion of which is permanently or detachably secured to a coupling element 10 at the front side of the rear plate 4. The elements 9, 10 ensure that the plates 3, 4 cannot move beyond the illustrated second positions. These plates consist of a ceramic material, for example, hard-paste china.

The front plate 3 has an exposed side or surface which faces the observer of FIG. 1 and is provided with an image 5 as well as with a text 6, e.g., a proverb, a verse, an excerpt from a literary work or the like. The reference character 7 denotes a preferably (but not necessarily) handwritten message at the inner side of the rear plate 4. The message 7 may be a congratulatory message to a graduate, a congratulatory message to a person who was promoted in his or her job, a congratulatory message to one or more celebrants of an anniversary, an expression of sympathy to a bereaved person, a religious message for a particular holiday, a message to newlyweds, proud parents, returnees from a long trip, etc., etc. It is often desirable to provide on the plate 3 and/or plate 4 room and facility for the application of a handwritten message by the sender, i.e., to treat or otherwise prepare certain portions of the plate 3 and/or 4 in such a way that these portions will accept and retain a handwritten message so as to lend an individual touch to the letter card and to even further enhance the value of the card to the recipient(s).

As mentioned above, the plates 3 and 4 consist of a ceramic material, preferably a hard-paste porcelain, and they may have a thickness in the order of 3 mm. The thickness can vary within a wide range; for example, if the letter contains a single plate, the thickness of such plate can be twice the thickness of each of the illustrated plates 3 and 4. Alternatively, the letter card may include more than two relatively thin ceramic plates.

The retaining element 9 constitutes but one form of means for holding the plates 3 and 4 against pivotal movement beyond the illustrated second positions (in two mutually inclined planes). For example, the lower edge portions *2a* of the plates 3 and 4 can be inserted into a tray-like receptacle whose width corresponds to the maximum permissible distance between the lower edge portions *2a*. The connection between the elements 9 and 10 and/or between the element 9 and the plate 3 is preferably separable so as to allow for placing of the two plates into a common plane, e.g., to exhibit selected sides of the two plates on a layer of satin, silk, velvet or the like. The element 10 may constitute one-half of a pushbutton which includes a complementary second part secured (e.g., bonded) to the inner side of the rear plate 4. The element 10 is then permanently or more or less permanently secured to the respective end portion of the retaining element 9.

The text 6 may be applied by resorting to a suitable lacquer which is thereupon permanently affixed to the ceramic base material by appropriate heating or in another suitable way. However, it is equally possible to resort to other types of lacquers, writing fluids or the like. To this end, the exposed surface of the plate 3 is properly treated so as to accept and retain the writing fluid for practically unlimited periods of time, for example, for many generations. Thus, a letter card which embodies one or more ceramic plates and is sent to a child or teenager on the occasion of his or her First Communion or confirmation can be enjoyed by the same person at the age of eighty or more. The durability of the improved letter card is practically unlimited, the same as the durability of image or images, text or texts and/or message or messages thereon, depending solely on the quality of the product, i.e., on selection of the ceramic base material and of the material or materials which are used for reception and retention of the image or images, text or texts and/or message or messages. A ceramic material and the typical pronounced or characteristic ceramic paints or inks are ideally suited for the making of a letter card which can provide a practically unlimited opportunity for expression to a gifted artist, to a commercial artist, to a person skilled in the art of applying information of any kind to ceramic materials or even to a gifted or experienced individual who pursues the making of ceramic letter cards as a hobby rather than as a full-time or part-time occupation. By proper selection of inks and/or paints which make up the parts 5, 6 and 7 of the card 1, one can create an eye-pleasing array of information which can be readily seen and enjoyed at a considerable distance, even if the dimensions of the plates 3 and 4 are relatively small.

The message 7 can be applied to a porous and absorbent surface of the plate 4 or to a matte surface which is suited to accept and retain various forms of lacquer, ink and/or other coloring matter suitable for use on a ceramic material. In fact, the lettering of the message may also consist of a ceramic material, e.g., a pulverulent ceramic material which is dispersed in a liquid and is caused to permanently adhere to the material of the plate 4 by resorting to a heating, drying and/or other action capable of ensuring the establishment of a reliable bond between the two ceramic materials. Commercially available porcelain and glass lacquers are but one type of writing material which can be used for the application of the message 7, and such materials can be permanently embedded or otherwise impressed into the material of the plate 4, e.g., in a kitchen oven. A suitable writing implement for the application of lacquer or another writing fluid can be furnished with the improved letter by the store or stores which deal in such types of commodities.

As mentioned above, the application of the message 7 can be facilitated by appropriate treatment of that portion of the plate 3 and/or 4 which is to receive the message. Appropriate treatment can involve the imparting of a matte finish and/or the selection of a porous and absorbent material. For example, the inner side of the plate 4 can be provided with a layer of paper, textile or synthetic plastic material which is bonded to the plate 4, preferably to the bottom surface in a suitably configurated and dimensioned recess at the inner side of this plate. The layer of paper, textile or plastic may be in the form of woven material, fleece or a combination of both. In such instances, the exposed surface of the layer can bear a message which is applied by resorting to a conventional ink, e.g., to ink of the type contained in ball point pens or the like. Alternatively, the message 7 may consist of a ceramic material which is applied to the ceramic base material by sintering or an equivalent treatment.

Hard-paste porcelain is a presently preferred ceramic material of the plates 3 and 4 because it is relatively strong (breakage-resistant) and is especially suited for the making of relatively thin plates. Moreover, many commercially available decorative paints or inks are suited for the application of images, texts or like decorative and/or informative material to hard-paste china. Furthermore, the basic color of hard-paste china is white so that it can be inscribed with a dark ink, i.e., the message or text makes the same impression and can be read or otherwise interpreted with the same facility as a customary written, typed or imprinted message on white paper.

A letter card which is assembled of two plates is but one of the presently preferred embodiments of the improved card. Thus, the card may consist of a single plate the front side of which bears the image 5 and/or the text 6 and the rear side of which bears a message 7. Alternatively, the letter card may include three or even more plates which are articulately connected to each other in zig-zag formation so that they can be folded over each other prior to insertion into the envelope. Furthermore, the illustrated two-plate card 1 can be designed in such a way that the rear side of the front plate 3 as well as both sides of the rear plate 4 are treated for reception of handwritten messages, i.e., the major part of the letter card can serve for reception of one or more messages and the remaining part or parts of the card can remain blank or bear suitable decorative and/or instructive information or indicia. Rigidity of the material of the plate or plates of which the letter card is assembled allows for ready mounting on top of a table or the like, for example, in a manner as shown in FIG. 1, for suspension of the plate or plates on a wall by resorting to an eyelet (such as the eyelet 100 shown by broken lines at the rear side of the front plate 3), by mounting one or both plates in a suitable frame, by placing one or both plates into a tray which has a suitable background (e.g., of silk, velvet or the like), or by bonding the plate 3 and/or 4 to a suitable carrier in the form of a board or the like. The eyelet 100 may constitute an extension of a layer 101 which is applied to the rear side of the plate 3 and is treated to accept and retain a written message. A similar layer can be provided at one or both sides of the plate 4.

The letter card 1 may constitute a relatively inexpensive item which can be afforded by children or an expensive artist's work of great and continuously growing value. The same holds true for the dimensions, configuration thickness, weight and/or mode of suspending or otherwise exhibiting the letter card, i.e., each of these parameters or characteristics can vary within a wide range. A relatively simple letter card will consist of a single plate which, in a manner resembling that of conventional letter cards made of paper or lightweight cardboard, bears some decorative material at the front side and is provided with a layer (such as 101) at the rear side to enable the sender to write a personal message to one or more recipients. In fact, it is also possible to provide a letter card which, though made of a ceramic material, resembles a purely utilitarian conventional letter card, i.e., a card which is designed to accept massages at each and every side thereof. For example, a sender having a highly characteristic and eye-pleasing handwriting will purchase a ceramic card to apply a message to both sides of the plate and to thereupon treat or allow for treatment of the message for the purpose of preventing fading with time. Alternatively, the purchaser may wish to select a card which is sent without any personal message, i.e., which merely bears some decorative, informative or commemorative message in the form of one or more images, proverbs, verses or the like. Still further, the seller of the letter card can be equipped to apply to a purchased card a message in the form of printing so as to impart to the message an eye-pleasing appearance but without a personal touch (save perhaps for the selected contents of the message).

Figure 2:
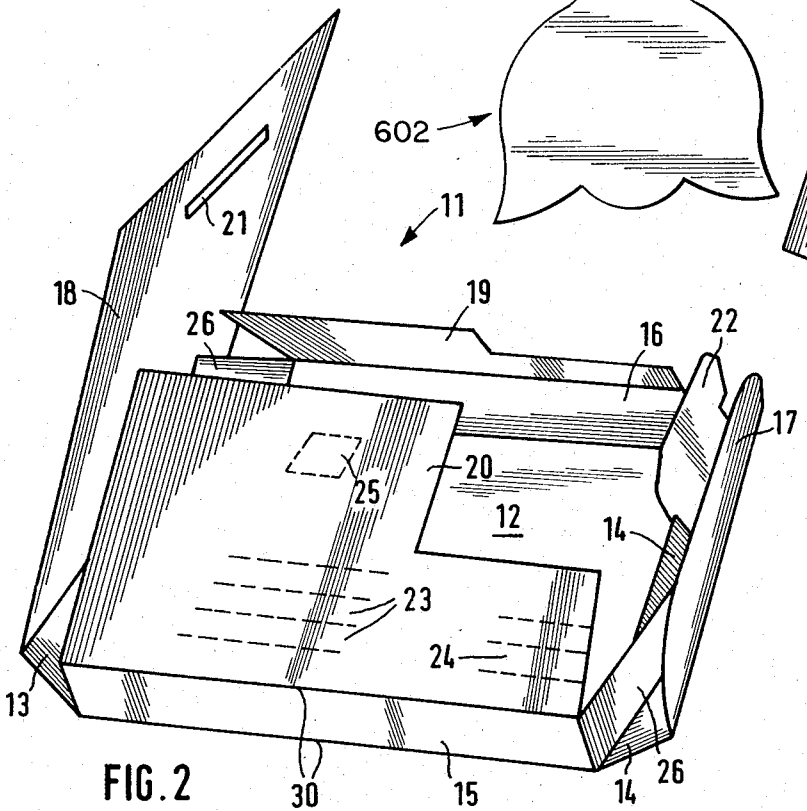
FIG. 2 is a perspective view of a partially closed envelope for the letter card of FIG. 1 or an analogous card.

FIG. 2 illustrates a presently preferred envelope 11 which need not deviate from certain presently known types of commercially available envelopes or boxes for fragile or otherwise sensitive commodities. The illustrated envelope 11 has two main panels including a first panel 12 and a second panel which is assembled of two pairs of tabs 17, 18 and 19, 20. These tabs are respectively integral with four relatively narrow side walls 14, 13, 16, 15 which, in turn, are integral with the respective edge portions of the panel 12. The tabs 17, 18 partially overlap each other when the envelope 11 is fully assembled and are, in turn, overlapped by the tabs 17, 18 which also partially overlap one another. The envelope 11 is releasably held in assembled condition by coupling means in the form of a tongue 22 which is provided on the tab 17 and is insertable through an elongated slot 21 in the respective portion of the tab 18. The tongue 22 has two undercuts which engage the surfaces at the respective ends of the slot 21 to reduce the likelihood of accidental opening of the envelope 11 during shipment to the recipient(s). Reinforcing flaps 26 on the side walls 15 and 16 enhance the stiffness of the assembled envelope.

The outer side of the major panel 12 has a space 25 for the application of one or more stamps, a field 23 for the name and address of the recipient(s), and a field 24 for the name and address of the sender(s).

Figure 3:
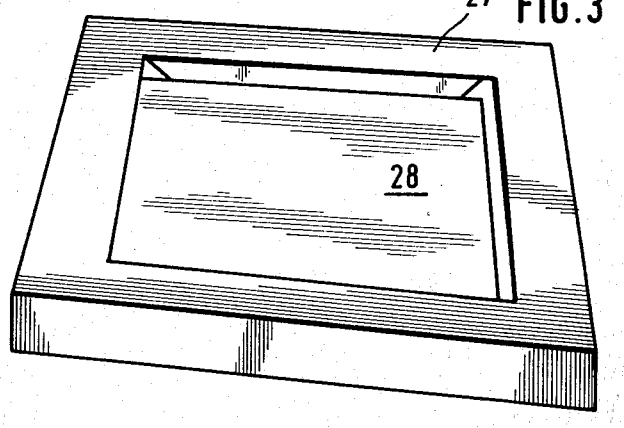
FIG. 3 is a perspective view of a protecting insert which can receive the letter card prior to insertion into the envelope of FIG. 2 or an analogous envelope.

The reference characters 30 denote fold lines between the neighboring side walls 13–16 as well as between the side walls 13–16 on the one hand and the flaps 26, panel 12 and tabs 17–20 on the other hand. Such fold lines facilitate the closing of the envelope by an unskilled person and enhance the likelihood of the making of a hollow parallelepiped envelope which can stand pronounced deforming stresses. The material of the envelope 11 is preferably corrugated cardboard of requisite stiffness and shock absorbency. Such material need not be particularly thick, especially if the improved letter further comprises a reinforcing and protecting insert 27 of the type shown in FIG. 3. This insert has a front or rear side provided with a socket, recess or depression 28 dimensioned to receive the plates 3, 4 (in the first positions of such plates) with a minimum of play so that the edge faces of the plates are in frictional contact with the surfaces surrounding the recess 28. This reduces the likelihood of wobbling of plates 3, 4 during shipment of the filled and closed envelope 11. The material of the insert 27 may be the same as that of the envelope 11. The dimensions of the insert 27 are selected with a view to enable the insert to fit snugly into the fully assembled envelope 11. The provision of such insert further enhances the rigidity of the envelope so that the plates 3, 4 are adequately protected during shipment, even if the letter is subjected to rough treatment, e.g., by dropping it onto the floor or another hard surface. The envelope 11 and/or the insert 27 can be furnished in the form of a blank which is properly cut to size and is provided with the necessary fold lines so that the insert blanks can be converted into a substantially frame-like body of the type shown in FIG. 3 and the envelope blank can be converted into a hollow parallelepiped which is capable of standing pronounced deforming stresses with or in the absence of the insert 27.

FIG. 9 shows a modified insert 127 having a front plate provided with a rectangular or otherwise shaped window 128 for a light-transmitting pane or sheet 129 which allows for observation of the contents of the insert 127. The letter card can be inserted through a lateral slot 130 and is held in the insert 127 with at least some friction so that it is not necessary to close the slot 130 when the insert contains a letter card.

FIG. 4 illustrates a rectangular letter card which comprises a single plate 102 with a sheet 102*a* of cardboard, paper or like stationery material pasted to its rear side. The sheet 102*a* has an integral displaying eyelet 102*b* which is inwardly adjacent to one shorter edge portion 102*d* of the plate 102 substantially midway between the longer edge portions 102*c* and can be bent out of the general plane of the sheet 102*a* within the confines of the plate 102 to allow for suspension on a hook, nail or the like.

FIG. 5 illustrates a letter card having a single plate 202, a sheet 202*a* of cardboard or the like which is bonded to the rear side of the plate 202, and a displaying eyelet 202*b* which forms an integral part of the sheet 202*a* within the confines of the plate 202 and can be bent out of the general plane of the sheet to facilitate suspension on a nail or the like. The eyelet 202*b* is adjacent to a longer edge portion 202*c* of the plate 202 midway between the shorter edge portions 202*d*. The sheet 202*a* serves for the application of messages by the sender(s) of the letter card.

FIG. 6 shows a further letter card which is similar to that of FIG. 1 except that each of its plates 302, 303 has an image bearing outer side. The neighboring longer edge faces 302*c*, 303*c* of the plates 302, 303 are articulately connected to each other by one or more hinges, e.g., in a manner as shown in FIG. 1. An advantage of this card is that it can be observed from opposite sides because each such side presents an image on the respective plate 302 or 303. Thus, if such a card is set up on a desk or table, the person sitting behind the desk or table will see a first image or group of images, and the person sitting or standing in front of the disk or table will see a different second image or group of images. The displaying means includes the edge portions 302*c*', 303*c*'.

FIG. 7 shows the rear side of an oval plate 402 having a sheet 402*a* bonded thereto. The sheet 402*a* is formed with an eyelet 402*b*.

Figure 10:
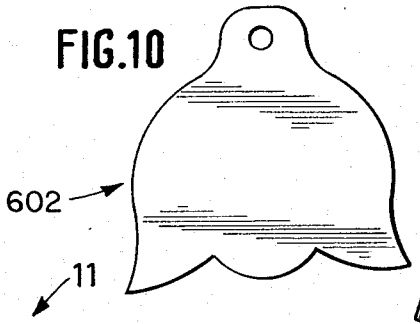
FIG. 10 is a rear elevational view of a letter card which resembles a flower.

FIG. 8 shows a further plate 502 which resembles a bottle or a bell and the neck portion of which has a hole 502*b* for suspension of the card on a nail, hook or the like. FIGS. 7 and 8 are representative of only two different plates whose shape deviates from the customary (rectangular) shape of a letter card. The number of configurations which deviate from a rectangular outline is practically inexhaustible. For example, the outline of the letter card can resemble that of a flower (see the card 602 of FIG. 10) so that the appearance of the card is suggestive of its purpose (e.g., condolence or birthday celebration). A bell is suggestive of wedding, a boat or airplane is suggestive of a trip, a flag is suggestive of a national holiday, a church is suggestive of a religious holiday, a ball or a cup is suggestive of a victory in a certain branch of sports activity, and so forth. Of course, the image or picture at the front side of a letter card whose outline is supposed to suggest a particular event or occasion can also suggest or depict such event or occasion, or the front side can bear a message which specifically spells out the reason for mailing or delivering the card.

An important advantage of the improved letter is that its card can be used and exhibited as a highly decorative miniature picture which remains unchanged for generations or centuries, which can be exhibited in any desired position (with or without framing), and which can be observed at all times in the same way as other decorative pieces which are distributed in a well kept house to contribute to the comfort and well-being of occupants. The envelope and the insert ensure that the letter card can be shipped or mailed in the same way as regular mail or parcels., i.e., at a reasonable cost, without risking damage or destruction except, of course, by extremely rough treatment or on purpose.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

I claim:

1. A letter, comprising a letter card including at least one relatively thin plate consisting of a ceramic material and having a first side bearing permanently applied decorative material in the form of one or more images and/or lettering and a second side; a sheet of stationery material applied to the second side of the plate; means for displaying the plate; and a shock-absorbent envelope for at least substantial concealment and confinement of the letter card and for protecting the letter card against damage during mailing or other forms of shipment.

2. The letter of claim 1, wherein said plate has a substantially rectangular outline with two longer edge portions and two shorter edge portions, said displaying means being adjacent to one of said shorter edge portions substantially midway between said longer edge portions.

3. The letter of claim 1, wherein said plate has a substantially rectangular outline with two longer edge portions and two shorter edge portions, said displaying means being adjacent to one of said longer edge portions substantially midway between said shorter edge portions.

4. The letter of claim 1, wherein said card includes two plates and means for articulately connecting said plates to one another so that said first sides thereof face outwardly, said first side of said second plate also bearing permanently applied decorative material in the form of one or more images and/or lettering.

5. The letter of claim 4, wherein said plates have edge portions remote from said connecting means and said displaying means includes said edge portions.

6. The letter of claim 1, wherein said plate has an outline other than a rectangular outline.

7. The card of claim 6, wherein the outline of said plate resembles that of a flower.

8. The card of claim 6, wherein the outline of said plate resembles that of a bottle.

9. The card of claim 6, wherein the outline of said plate resembles that of a bell.

10. The card of claim 1, further comprising an insert for confining said plate in the interior of said envelope, said insert being receivable in said envelope and having a lateral slot for insertion of the plate into its interior.

11. The card of claim 1, further comprising an insert for confining said plate in the interior of said envelope, said insert having a window adjacent to the first side of the plate therein and a light-transmitting pane in said window.

12. The card of claim 1, wherein said sheet consists of paper or cardboard and is bonded to the second side of said plate.

13. The card of claim 1, wherein said displaying means forms an integral part of said sheet.

14. A letter, comprising a letter card including at least one relatively thin plate consisting of a ceramic material and having a first side bearing permanently applied decorative material in the form of one or more images and/or lettering and a second side capable of receiving and retaining a written or printed message; means for displaying said plate for observation of said first side thereof, said displaying means being disposed within the confines of said plate at said second side thereof; and a shock-absorbent envelope for at least substantial concealment of the letter card and for protecting the latter against damage during mailing or other forms of shipment.

15. The letter of claim 14, wherein said displaying means comprises an eyelet which is bonded to the second side of said plate.

16. The letter of claim 14, wherein the outline of said plate deviates from a rectangular outline.

17. The letter of claim 14, wherein said plate has a plurality of edge portions and said displaying means is nearer to one of said edge portions than to the other edge portions.

18. The letter of claim 14, wherein said displaying means consists of paper or cardboard.

19. As a novel article of manufacture, a letter card including at least one relatively thin plate consisting of a ceramic material and having a first side bearing permanently applied decorative material in the form of one or more images and/or lettering and a second side capable of receiving and retaining a written or printed message, said plate having an outline other than a rectangular outline; and means for displaying said plate for the observation of said front side thereof.

20. The letter card of claim 20, further comprising a sheet of paper, cardboard or the like bonded to said plate and defining said second side.

* * * * *